US008779884B2

(12) United States Patent
Kim et al.

(10) Patent No.: US 8,779,884 B2
(45) Date of Patent: Jul. 15, 2014

(54) MULTILAYERED INDUCTOR AND METHOD OF MANUFACTURING THE SAME

(75) Inventors: Myeong Gi Kim, Gyunggi-do (KR); Sung Yong An, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 13/402,350

(22) Filed: Feb. 22, 2012

(65) Prior Publication Data

US 2013/0147591 A1 Jun. 13, 2013

(30) Foreign Application Priority Data

Dec. 8, 2011 (KR) ..... 10-2011-0130933

(51) Int. Cl.

| | |
|---|---|
| ***H01F 5/00*** | (2006.01) |
| ***H01F 27/02*** | (2006.01) |
| ***H01F 27/30*** | (2006.01) |
| ***H01F 27/24*** | (2006.01) |

(52) U.S. Cl.

USPC ..... 336/200; 336/83; 336/92; 336/205; 336/233; 336/234

(58) Field of Classification Search

USPC ..... 336/200, 83, 92, 205, 232, 233, 234

See application file for complete search history.

(56) References Cited

U.S. PATENT DOCUMENTS

| | | | | |
|---|---|---|---|---|
| 6,573,821 | B2 * | 6/2003 | Peels et al. | 336/200 |
| 6,962,753 | B1 * | 11/2005 | Yoshida et al. | 428/469 |
| 2002/0153258 | A1 * | 10/2002 | Filas et al. | 205/119 |
| 2008/0246578 | A1 * | 10/2008 | Ahn et al. | 336/200 |
| 2009/0045905 | A1 * | 2/2009 | Nakagawa et al. | 336/232 |
| 2011/0115599 | A1 * | 5/2011 | Otsuki et al. | 336/221 |
| 2011/0133881 | A1 * | 6/2011 | Nakajima et al. | 336/200 |
| 2011/0260825 | A1 * | 10/2011 | Doljack et al. | 336/221 |
| 2012/0105188 | A1 * | 5/2012 | Lim et al. | 336/200 |

FOREIGN PATENT DOCUMENTS

KR 10-2006-0087252 A 8/2006

* cited by examiner

*Primary Examiner* — Alexander Talpalatski
*Assistant Examiner* — Kazi Hossain
(74) *Attorney, Agent, or Firm* — McDermott Will & Emery LLP

(57) ABSTRACT

There is provided a multilayered inductor, including: an inductor body; a coil part formed on the inductor body and having a conductive circuit and a conductive via; and external electrodes formed on both end surfaces of the inductor body, wherein the inductor body includes 65 to 95 wt % of a metallic magnetic material and 5 to 35 wt % of an organic material.

9 Claims, 6 Drawing Sheets

MULTILAYERED INDUCTOR AND METHOD OF MANUFACTURING THE SAME

CROSS-REFERENCE TO RELATED APPLICATIONS

This application claims the priority of Korean Patent Application No. 10-2011-0130933 filed on Dec. 8, 2011, in the Korean Intellectual Property Office, the disclosure of which is incorporated herein by reference.

BACKGROUND OF THE INVENTION

1. Field of the Invention

The present invention relates to a multilayered inductor and a method of manufacturing the same.

2. Description of the Related Art

As electronic parts using a ceramic material, there may be provided a capacitor, an inductor, a piezoelectric element, a varistor, a thermistor and the like.

Among these ceramic electronic components, the inductor, together with a resistor and the capacitor, is one of the main passive elements constituting an electronic circuit, and serves to remove noise or to constitute an LC resonance circuit.

Inductors are classified into several types; a wired inductor, manufactured by winding a wire or printing a coil on a ferrite core according to a structure thereof and forming electrodes at both ends thereof, a multilayered inductor, manufactured by printing internal electrodes on a magnetic material or a dielectric material and then laminating layers thereof in plural, or a thin film inductor, and the like.

The multilayered inductor may be miniaturized, have a relatively reduced thickness and have strengths in terms of DC resistance, as compared to the wired inductor, such that it is widely used in a power supply circuit or the like required to be miniaturized and have high capacitance.

The multilayered inductor may be manufactured in a laminate form in which a plurality of ceramic sheets formed of a number of ferrites or the dielectric material having low-k dielectric, are laminated in vertical direction.

A coil-shaped metal pattern is formed on each ceramic sheet. The coil-shaped metal patterns formed on respective ceramic sheets are sequentially connected to each other through conductive vias formed in the respective ceramic sheets, and overlapped with each other in a laminated direction, thereby constituting a coil part having a spiral structure.

The multilayered inductor may be manufactured as a separate component in a chip shape, or may be formed together with other modules embedded in a substrate, if necessary.

Meanwhile, among the inductors, there is provided a so called "power inductor" having high current.

The power inductor is mainly used in a power supply circuit such as a DC-DC converter in a portable device, which requires small inductance (L) value change rate for used current and temperature.

The multilayered power inductor may be reduced in thickness to have strengths in miniaturization and DC resistance as compared to the wired power inductor, however, the multilayered power inductor may be greatly affected structurally by an open magnetic path, whereby a change in inductance (L) value according to the current application is large.

In order to solve this defect, the multilayered power inductor according to the related art partially includes a nonmagnetic Gap layer in an inner structure thereof to reduce magnetic flux, thereby improving a change characteristic in inductance (L) value according to a current application.

SUMMARY OF THE INVENTION

An aspect of the present invention provides a multilayered inductor capable of being compact and having high capacitance, without including the nonmagnetic gap layer in the inner structure thereof, can improve an inductance (L) value change according to a current application.

According to an aspect of the present invention, there is provided a multilayered inductor, including: an inductor body; a coil part having a conductive circuit and a conductive via formed on the inductor body; and external electrodes formed on both end surfaces of the inductor body, wherein the inductor body includes 65 to 95 wt % of a metallic magnetic materials and 5 to 35 wt % of an organic materials.

The metallic magnetic material may include an Fe-based alloy and an Fe-based amorphous material.

The Fe-based alloy and the Fe-based amorphous material may have 100 to 250 emu/g of a saturation magnetization value.

The Fe-based alloy and the Fe-based amorphous material may have Fe having a content of 50% or more.

The conductive circuit may be formed of silver (Ag) or copper (Cu).

The multilayered inductor may further include upper and lower cover layers respectively formed on upper and lower portions of the inductor body.

Here, the upper and lower cover layers each may include 65 to 95 wt % of the metallic magnetic material and 5 to 35 wt % of the organic material.

According to another aspect of the present invention, there is provided a method of manufacturing a multilayered inductor, the method including: preparing a plurality of sheets each having a conductive circuit and a conductive via and formed of 65 to 95 wt % of a metallic magnetic material and 5 to 35 wt % of an organic material; and forming an inductor body by laminating the plurality of sheets so that one end of the conductive circuit formed on each of the sheets is contacted with the conductive via formed in a neighboring sheet to thereby form a coil part.

The method may further include forming upper and lower cover layers on upper and lower portions of the inductor body, respectively, the upper and lower cover layers being formed of the same material as the sheets.

The method may further include manufacturing a chip by compressing and cutting the inductor body; and forming external electrodes on both end surfaces of the chip.

The method may further include plating surfaces of the inductor body and the external electrodes.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
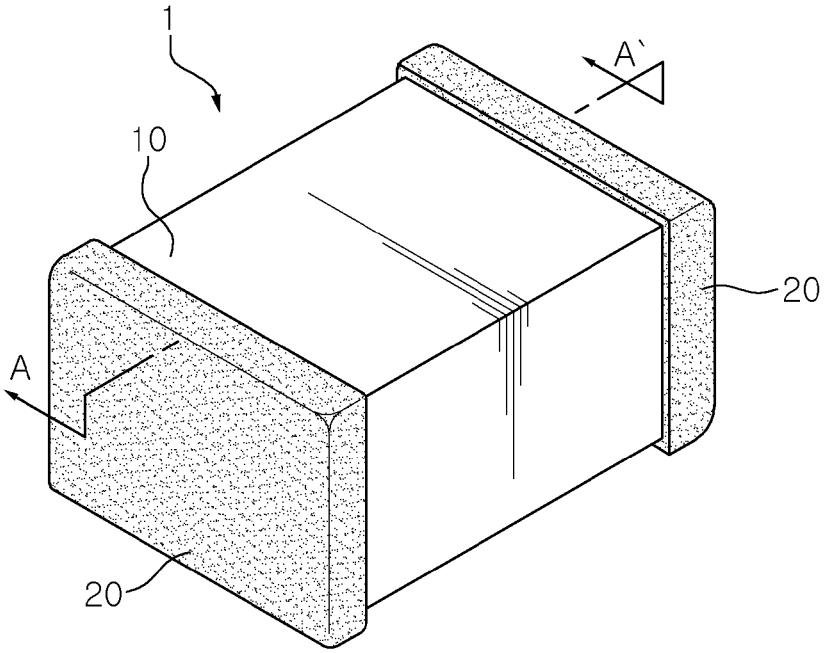
FIG. 1 is a perspective view showing a multilayered inductor according to an embodiment of the present invention.

Embodiments of the present invention will now be described in detail with reference to the accompanying drawings.

The invention may, however, be implemented in many different forms and should not be construed as being limited to the embodiments set forth herein.

Rather, these embodiments are provided so that this disclosure will be thorough and complete, and will fully convey the concept of the invention to those skilled in the art.

In the drawings, the shapes and dimensions may be exaggerated for clarity, and the same reference numerals will be used throughout to designate the same or like components.

In addition, like reference numerals denote parts performing similar functions and actions throughout the drawings.

In addition, unless explicitly described otherwise, "comprising" any components will be understood to imply the inclusion of other components but not the exclusion of any other components.

Figure 2:
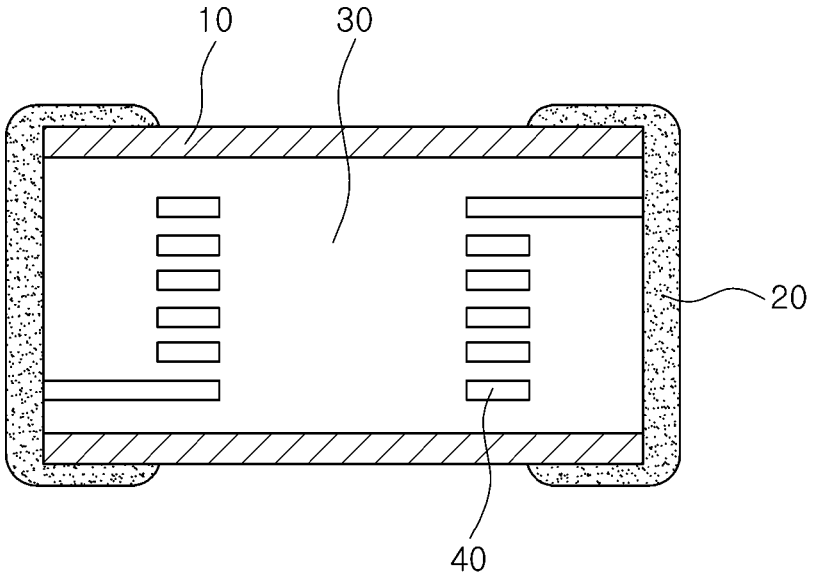
FIG. 2 is a cross-sectional view taken along line A-A' of FIG. 1.

Referring to FIGS. 1 and 2, a multilayered inductor 1 according to an embodiment of the present invention may include an inductor body 30, a coil part 40 formed in the inductor body 30, and a pair of external electrodes 20 formed on both end surfaces of the inductor body 30.

Figure 3:
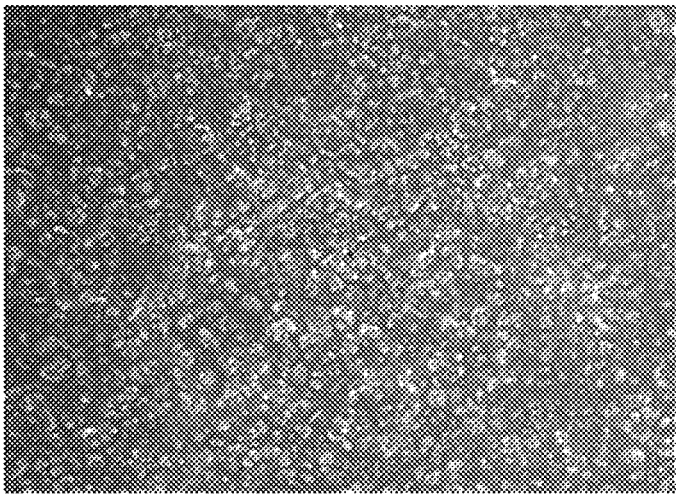
FIG. 3 is a scanning electron microscope (SEM) photograph magnifying a molding sheet of the multilayered inductor according to an embodiment of the present invention.

FIG. 3 is a scanning electron microscope (SEM) photograph magnifying a molding sheet configuring the inductor body 30 according to an embodiment of the present invention.

A wired inductor has a small change in an inductance value according to a current application, however, the multilayered inductor has a great change in an inductance value according to the current application, which may be a shortcoming.

Referring to FIG. 3, the inductor body 30 may be formed of 65 to 95 wt % of a metallic magnetic material and 5 to 35 wt % of an organic material.

That is, in a case in which the content of the metallic magnetic material may be less than 65 wt %, a sufficient inductance L value may not be implemented with regard to a ratio of these materials, and in a case in which the content of the metallic magnetic material is more than 95 wt %, chip characteristics may not be implemented as they are.

That is, as shown in Sample 5 of Table 1 below, among composite magnetic materials configuring the inductor body 30, when the content of the metallic magnetic material is less than 65 wt %, permeability of the body may be significantly reduced to less than 5, and thus it can be seen that, when a multilayered chip is manufactured, sufficient inductance may not be implemented.

In addition, as shown in Sample 1 of Table 1 below, among the composite magnetic material components configuring the inductor body 30, when the content of the metallic magnetic material is more than 95 wt %, the permeability of the body may be relatively high, for example, 40, but an insulation thereof may not be secured, and as a result, a metallic magnetic material and a metallic component of a conductive circuit among the composite magnetic materials configuring the inductor body 30 may contact each other.

Therefore, since paths of currents between respective metal components included in the inductor body 30 and the conductive circuit are connected to each other to thereby cause a defect in conduction, chip characteristics may not be implemented as they are.

Therefore, as shown in Samples 2 to 4, the multilayered inductor 1 according to the embodiment of the present invention may include a composite of the metallic magnetic material having an appropriate content and the organic material, and thus the multilayered inductor may have an inductance change rate similar to that of a wired inductor.

TABLE 1

| sample | metal content: (wt %) | organic material content (wt %) | Permeability | Note |
|---|---|---|---|---|
| 1 | more than 95% | less than 5% | more than 40 | conduction occurs |
| 2 | 85~95% | 5~15% | 30~40 | — |
| 3 | 70~85% | 15~30% | 15~30 | — |
| 4 | 65~70% | 30~35% | 5~15 | — |
| 5 | less than 65% | more than 35% | less than 5 | — |

<Permeability of Composite Magnetic Material Components According to Content of Metallic Magnetic Material>

The inductor body 30 may be formed by laminating a plurality of sheets formed of these materials or by printing a paste formed of the same materials as those, as needed, however, a method of forming the inductor body 30 according to the embodiment of the present invention is not limited thereto.

The metallic magnetic material may include Fe, a Fe-based alloy or a sendust-based material or a Fe-based amorphous material.

Table 2 below shows a saturation magnetization value according to the metallic magnetic material type and component.

TABLE 2

| sample | kinds of metal magnet material | saturation-magnitization (Ms)(emu/g) |
|---|---|---|
| 6 | Fe(99% or more) | 192~250 |
| 7 | Fe—Si base (Fe content, 3~10%) | 172 |
| 8 | Fe—Si—Al, Sendust base | 100~115 |
| 9 | Fe—Ni base (Fe content, 50% or more) | 150 |
| 10 | Fe—Si—Cr base | 180 |
| 11 | Fe—Si—B—Cr amorphous base | 145 |

<Saturation Magnetization Values According to a Metallic Magnetic Material Type>

When the saturation magnetization value of the metallic magnetic material is relatively high, the change in inductance according to the current application may be reduced, whereby the inductance at high current may be maintained.

A DC-bias characteristic of a chip inductor may be determined by a function of a material characteristic and a coil structure. In the material having the same permeability, as the saturation magnetization value of the material increases, relatively excellent DC-bias characteristics may be obtained.

Here, in the case of Sample 6, a difference in saturation magnetization values may occur according to components other than Fe. In addition, in the case of Sample 8, a difference in saturation magnetization values may also occur according to components other than Fe.

Therefore, referring to Table 2 above, as shown in Samples 6 to 11, it can be confirmed that the Fe-based alloy and the Fe-based amorphous material have the saturation magnetization value of 100 to 250 emu/g.

In addition, the Fe-based alloy and the Fe-based amorphous material may have Fe having a content of 50% or more.

The reason is that when the content of Fe is less than 50 wt %, a saturation magnetization value may be reduced to 100 emu/g or less.

In addition, the organic material may be provided to prevent an oxidation of the metallic magnetic material simultaneously with providing insulation to the inductor body 30 of the chip device. The organic material may include, for example, a PVB based/acrylic based binder, a silane coupling agent, epoxy and the like.

A conductive circuit (not shown) may be formed on one surface of each of the sheets constituting the inductor body 30, and a plurality of conductive vias (not shown) may be formed to penetrate through each of the sheets in a thickness direction thereof.

The conductive circuit may be formed by a thick film printing method, a coating method, a depositing method, a sputtering method, or the like, but the present invention is not limited thereto.

The conductive circuit may be formed of conductive materials having excellent electro conductivity, and may be formed of materials having small resistance and cheap cost.

For example, the conductive circuit may be formed of at least one of silver (Ag) and copper (Cu) or an alloy thereof, but the present invention is not limited thereto.

The conductive via may be provided by forming a through hole in each of the sheets and then filling the through hole with a conductive paste.

In this case, the conductive paste may be formed of at least one of silver (Ag), silver-palladium (Ag—Pd), nickel (Ni) and copper (Cu), or an alloy thereof, but the present invention is not limited thereto.

One end of the conductive circuit formed on each sheet may contact the conductive via formed in a neighboring sheet.

In addition, the conductive circuits formed on the respective sheets may be connected to each other by the conductive vias, to form the wound coil part 40.

Here, the number of sheets on which the conductive circuits are formed may be variously determined depending on electric properties required in the multilayered inductor 1, such as a inductance value or the like.

In addition, output terminals formed in distal ends of the conductive circuits may be drawn out to the outside to thereby be electrically connected to left and right external electrodes 20, respectively.

Meanwhile, the multilayered inductor 1 may further include cover layers 10 formed on an upper portion and a lower portion of the inductor body 30.

In addition, an insulating layer (not shown) may be formed to surround an outer surface of the inductor body 30, as needed.

Here, when the upper and lower cover layers 10 are present, the insulating layer may be formed to surround the entire outer surface of the upper and lower cover layers 10.

In addition, the upper and lower cover layers 10 are not particularly limited, but may be formed by preparing a slurry using the same materials constituting the inductor body 30, that is, composite magnetic materials containing a metallic magnetic material of 65 to 95 wt % and an organic material of 5 to 35 wt %, and then using the prepared slurry.

A pair of external electrodes 20, formed on the outer surfaces of the inductor body 30, may be electrically connected to both ends of the coil part 40, respectively.

The external electrodes 20 may be formed by immersing the inductor body in conductive paste, printing, depositing, sputtering, or the like.

Here, the conductive paste may include silver (Ag), silver-palladium (Ag—Pd), nickel (Ni), copper (Cu), or the like.

In addition, a Ni plating layer and a Sn plating layer may be further formed on surfaces of the external electrodes, as needed.

Hereinafter, a method of manufacturing the multilayered inductor according to the embodiment of the present invention will be described.

First, a sheet formed of a material including a metal powder may be prepared.

Since the sheet is limited in view of a magnetic moment of a component element only with a ferrite powder synthesized on a spinel by mixing a metal oxide raw material and performing a calcine reaction process to thus have a limitation in increasing a saturation magnetization value (Ms), such that it is difficult to implement a higher saturation magnetization value for improving bias.

However, a saturation magnetization value of Fe is about 218 emu/g, about 3 times as compared to a maximum saturation magnetization value of oxide ferrite, such that a definite effect may be provided in the case of an increase in the saturation magnetization value.

Therefore, a Fe-based metallic magnetic material having a relatively high saturation magnetization value may be used in the present embodiment. In addition, a molding sheet may be produced using a composite of metallic and organic material so that a thermal process such as sintering, curing and the like, may be omitted regarding the inductor body 30.

A conductive circuit and a conductive via (not shown) may be formed on the molding sheet prepared as above. Here, the conductive circuit is not particularly limited, but may be formed by, for example, a thick film printing method, a coating method, a depositing method, a sputtering method, or the like.

In addition, the conductive via (not shown) may be provided by forming a through hole in the sheet and then filling the through hole with a conductive paste or the like.

Here, the conductive paste may include silver (Ag), silver-palladium (Ag—Pd), nickel (Ni), copper (Cu), or the like.

Next, an inductor body 30 may be formed by laminating a plurality of sheets.

Here, the plurality of sheets may be laminated such that one ends of the conductive circuits formed on each of the sheets contact the conductive vias formed in neighboring sheets, such that the conductive circuits are connected to each other by the conductive vias, thereby forming the wound coil part 40.

Next, a through hole may be formed in the coil part 40. The through hole is not particularly limited, but may be formed by using, for example, a laser or a punching machine.

Then, a core may be formed by filling the through hole formed in the coil part 40 with a material including the metal powder.

The core may be formed by preparing slurry by milling and mixing a magnetic powder, a binder, a plasticizer, and the like, using a ball mill, and by filling an inner portion of the core part with the slurry or a paste, but the present invention is not limited thereto.

Meanwhile, the upper cover layer 10 may be formed by laminating an upper cover sheet on the inductor body 30 or printing a paste formed of the same material as that of the upper cover sheet.

Further, the lower cover layer 10 may be formed by laminating a lower cover sheet on a lower portion of the inductor body 30 or printing a paste formed of the same material as that of the lower cover sheet.

Then, the inductor body 30 having the core formed therein may be fired, and a pair of external electrodes 20 may be formed on the outer surfaces of the inductor body 30 so as to be electrically connected to both ends of the coil part 40, respectively.

The external electrodes 20 may be formed by immersing the inductor body in the conductive paste, printing, depositing, sputtering, or the like.

Here, the conductive paste may include silver (Ag), silver-palladium (Ag—Pd), nickel (Ni), copper (Cu), or the like.

In addition, a Ni plating layer or a Sn plating layer may further be formed on surfaces of the external electrodes 20 formed as above by plating Ni or Sn, as needed.

Meanwhile, a cut green chip may be implemented as the multilayered inductor through a de-binder process and a firing process. However, according to the embodiment of the present invention, the chip may be completed by applying the external electrodes to a green chip and curing the external electrodes at a temperature of 150 to 200° C., without being subjected to a de-binding process and a firing process.

Figure 4:
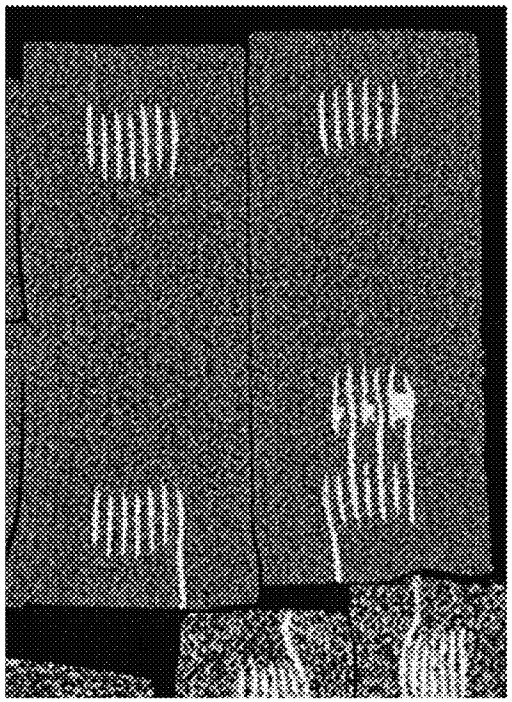
FIG. 4 is a scanning electron microscope (SEM) photograph magnifying the cross-section of a chip, for a portion thereof taken along line A-A' of FIG. 1, of the multilayered inductor.
Figure 5:
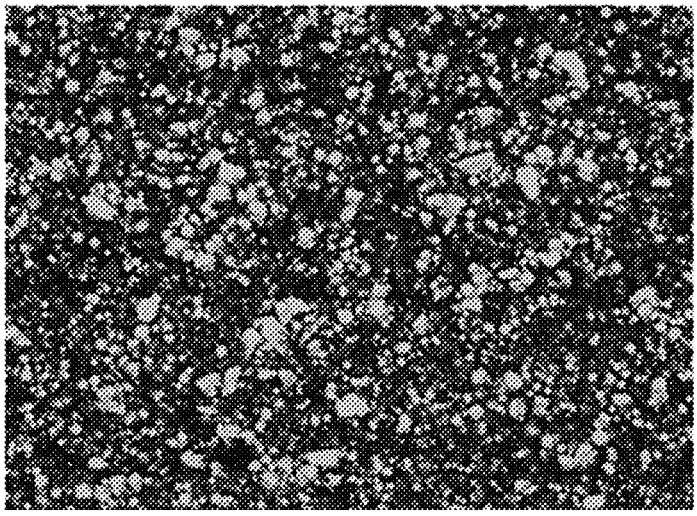
FIG. 5 is a scanning electron microscope photograph magnifying a center portion of the multilayered inductor according to an embodiment of the present invention.

Here, as shown FIGS. 4 and 5, particles of the metallic magnetic material disposed in the completed chip may be separated from each other, such that a short is not generated, whereby the chip characteristics may be easily implemented.

A DC bias characteristic of the inductor may be more enhanced as the inductance value change rate according to the current application is relatively small.

An efficiency of the inductor may be more improved as the inductance value change rate according to the current application at each temperature is relatively small.

With the wired inductor, a magnetic flux is limited by air, such that DC bias characteristics may be improved by reducing an inductance value change rate due to an open magnetic path effect.

Meanwhile, with the multilayered inductor, when the DC bias is applied while being increased, the inductance value change may be large to cause efficiency degradation.

However, according to the embodiment of the present invention, although DC bias is increased, the inductance value change rate may be reduced by relatively high saturation magnetization of the metallic magnetic material, whereby DC bias characteristics may be improved.

Figure 6:
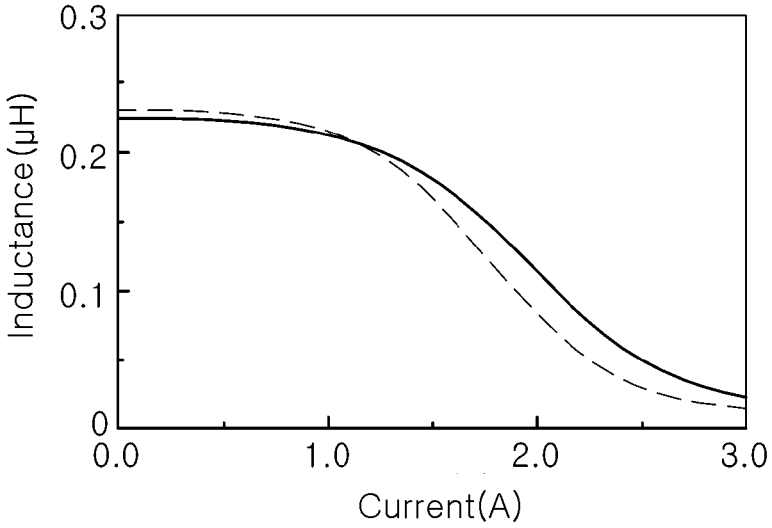
FIG. 6 is a graph showing a DC-bias characteristic of the multilayered inductor according to an embodiment of the present invention.

In FIG. 6, a solid line represents an inductance of the multilayered inductor according to the embodiment of the present invention and a dotted line represents an inductance of the wired inductor according to the related art. As shown in FIG. 6, it can be seen that the multilayered inductor according to the embodiment of the present invention has an inductance change rate similar to that of the wired inductor according to the related art.

As set forth above, according to the embodiments of the present invention, the multilayered inductor capable of being compact and having high current, without including the non-magnetic gap layer in the inner structure thereof, may improve a change characteristic in an inductance (L) value according to a current application.

While the present invention has been shown and described in connection with the embodiments, it will be apparent to those in the art that modifications and variations can be made without departing from the spirit and scope of the invention as defined by the appended claims.

What is claimed is:

1. A multilayered inductor comprising:

an inductor body;

a coil part having a conductive circuit and a conductive via formed on the inductor body; and external electrodes formed on both end surfaces of the inductor body, wherein:

the inductor body including 65 to 95 wt % of a metallic magnetic material and 5 to 35 wt % of an organic material, the metallic magnetic material includes an Fe-based alloy and an Fe-based amorphous material, and the Fe-based alloy and the Fe-based amorphous material have 100 to 250 emu/g of a saturation magnetization value.

2. The multilayered inductor of claim 1, wherein the Fe-based alloy and the Fe-based amorphous material have Fe having a content of 50% or more.

3. The multilayered inductor of claim 1, wherein the conductive circuit is formed of silver (Ag) or copper (Cu).

4. The multilayered inductor of claim 1, further comprising upper and lower cover layers respectively formed on upper and lower portions of the inductor body.

5. The multilayered inductor of claim 4, wherein the upper and the lower cover layers each include 65 to 95 wt % of the metallic magnetic material and 5 to 35 wt % of the organic material.

6. The multilayered inductor of claim 5, wherein the metallic magnetic material includes the Fe-based alloy and the Fe-based amorphous material.

7. The multilayered inductor of claim 6, wherein the Fe-based alloy and the Fe-based amorphous material have 100 to 250 emu/g of the saturation magnetization value.

8. The multilayered inductor of claim 6, wherein the Fe-based alloy and the Fe-based amorphous material have Fe having a content of 50% or more.

9. The multilayered inductor of claim 7, wherein the Fe-based alloy and the Fe-based amorphous material have Fe having a content of 50% or more.

* * * * *